US006138287A

United States Patent [19]

Chou

[11] Patent Number: 6,138,287

[45] Date of Patent: Oct. 31, 2000

[54] STRAPS FOR SWIMMING/DIVING GOGGLES

[76] Inventor: Terry Chou, No. 12, Hsin Ho Herng Road., Tainan City, Taiwan

[21] Appl. No.: 09/361,160

[22] Filed: Jul. 27, 1999

[51] Int. Cl.[7] ..... A61F 9/02

[52] U.S. Cl. ..... 2/452; 2/440; 128/207.11; 351/43

[58] Field of Search ..... 2/426, 428, 440, 2/442, 445, 458, 452, 430, 338, 9; 128/207.11; 351/43

[56] References Cited

U.S. PATENT DOCUMENTS 5,046,200 9/1991 Feder ..... 2/452
5,408,702 4/1995 Chiang ..... 2/428
5,524,300 6/1996 Chiang ..... 2/439
5,638,552 6/1997 Fujima ..... 2/428
5,829,064 11/1998 Huang ..... 2/428

*Primary Examiner*—John J. Calvert
*Assistant Examiner*—Katherine Moran
*Attorney, Agent, or Firm*—Rosenberg, Klein & Lee

[57] ABSTRACT

A strap for swimming/diving goggles includes two ends connected to the goggle frame and a looped mediate section having an upper loop section and a lower loop section. The loop sections have different stretchability. When applied to the rear of the user's head, the loop sections are stretched by different lengths and thus have the same restoring/retaining force, thereby providing reliable retaining effect and improved wearing comfort.

3 Claims, 5 Drawing Sheets

STRAPS FOR SWIMMING/DIVING GOGGLES

BACKGROUND OF THE INVENTION

1. Field of the Invention

The present invention relates to straps for swimming/diving goggles that provide improved wearing comfort and reliable retaining effect to the user.

2. Description of the Related Art

FIG. 6 of the drawings illustrates a conventional strap 1' for swimming/diving goggles. When in use, the strap 1' lies horizontally along the rear of the user's head, yet the retaining effect is poor. FIG. 7 illustrates another conventional strap 2' that includes two ends 21' and 22' connected to the goggle frame 3' (FIG. 8) and a mediate looped portion having two loop sections 23' and 24'. As illustrated in FIG. 8, when in use, the upper loop section 23' and the lower loop section 24' are stretched by different lengths "X" and "Y" such that the restoring force (i.e., the retaining force) of the upper loop section 23' is not the same as that of the lower loop section 24'. As a result, the upper loop section 23' might be too tight (the user feels uncomfortable) or the lower loop section 24' might be too loose (the retaining effect is poor).

FIG. 9 illustrates a further conventional strap arrangement for a pair of swimming/diving goggles 6'. The strap arrangement includes two straps 4' and 5' each folded once and arranged in a manner that an end of strap 4' is releasably engaged with a buckle end 51 ' of strap 5' and that the other buckle end 41' of strap 4' is releasably engaged with the other end of strap 5'. Such arrangement allows the straps 4' and 5' to be adjusted in length to provide comfort wearing and stable retaining effect. Nevertheless, the cost is higher, the assembly procedure is more complex, and adjustment is inconvenient and time-consuming.

The present invention is intended to provide a strap that mitigates and/or obviates the above problems.

SUMMARY OF THE INVENTION

It is a primary object of the present invention to provide a strap for swimming/diving goggles that provides reliable retaining effect and improved wearing comfort.

A strap for swimming/diving goggles in accordance with the present invention includes two ends connected to the goggle frame and a looped mediate section having an upper loop section and a lower loop section. The loop sections have different stretchability. Nevertheless, when applied to the rear of the user's head, the loop sections are stretched by different lengths and thus have the same restoring force (i.e., retaining force). Thus, the retaining effect is reliable and the wearing comfort is improved.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
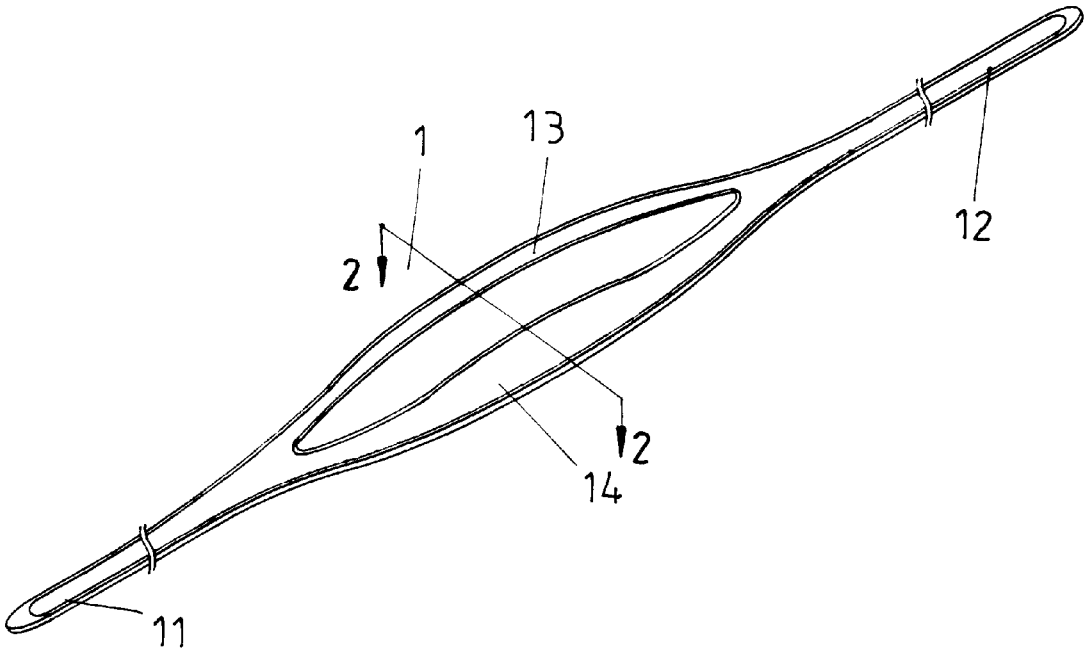
FIG. 1 is a perspective view of an embodiment of a strap for swimming/diving goggles in accordance with the present invention.
Figure 2:
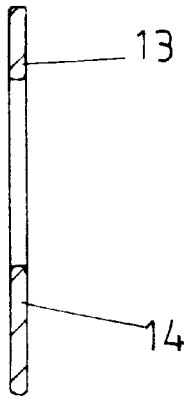
FIG. 2 is a sectional view taken along line A—A in FIG. 1.
Figure 3:
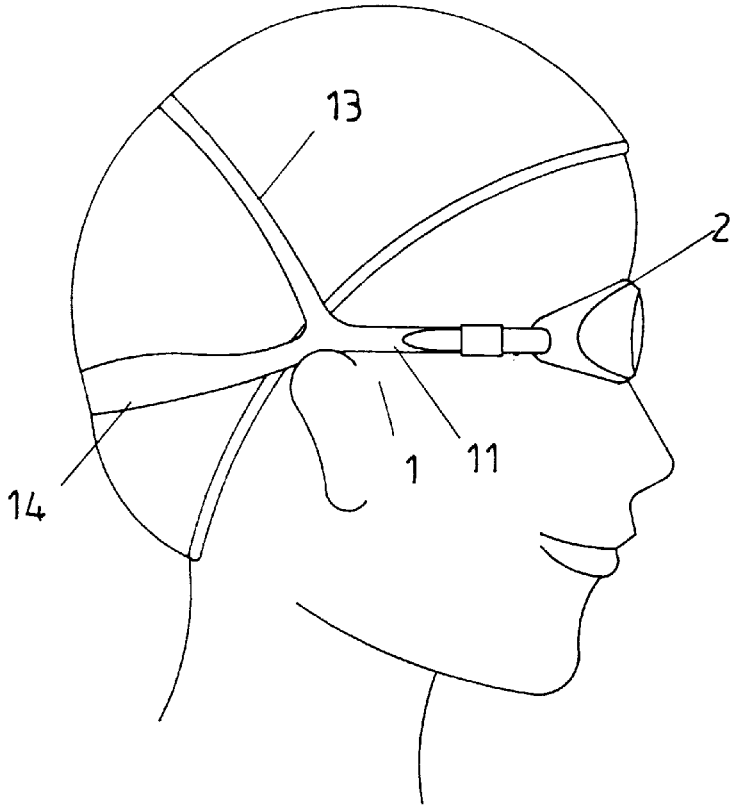
FIG. 3 is a schematic view illustrating use of the strap in FIG. 1.

Referring to FIGS. 1 through 5 and initially to FIGS. 1 and 2, a strap for swimming/diving goggles in accordance with the present invention is made of stretchable material and generally includes two ends of similar lenths 11 and 12 connected to a goggle frame 2 (FIG. 3) and a looped mediate section having an upper loop section 13 and a lower loop section 14. As illustrated in FIG. 2, the loop sections 13 and 14 have different widths (the width of the upper loop section 13 is smaller than that of the lower loop section 14) and thus have different stretchability. Nevertheless, when applied to the rear of the user's head, as shown in FIG. 3, the loop sections 13 and 14 are stretched by different lengths and thus have the same restoring force (i.e., retaining force). Thus, the retaining effect is reliable and the wearing comfort is improved.

Figure 4:
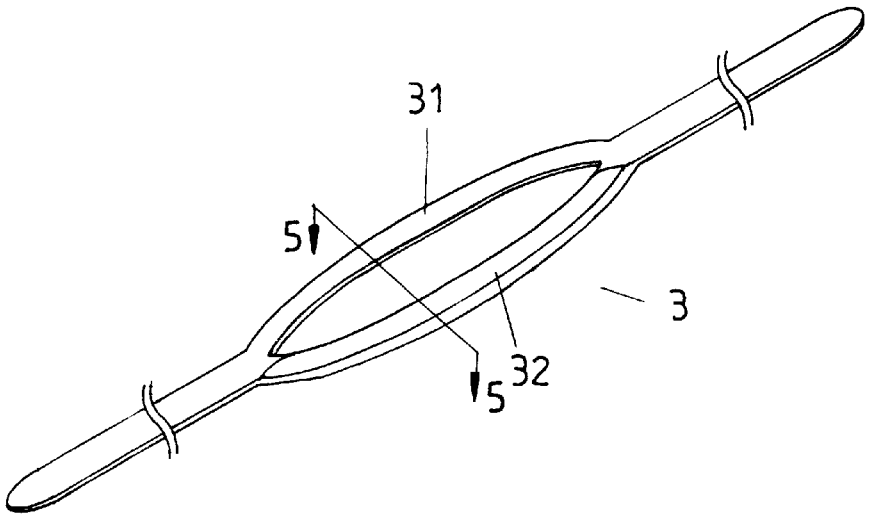
FIG. 4 is a perspective view of a further embodiment of the strap in accordance with the present invention.
Figure 5:
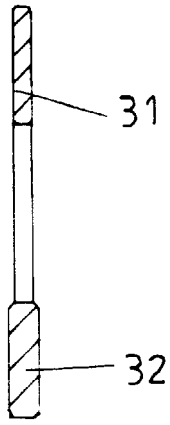
FIG. 5 is a sectional view taken along line B—B in FIG. 4.
Figure 6:
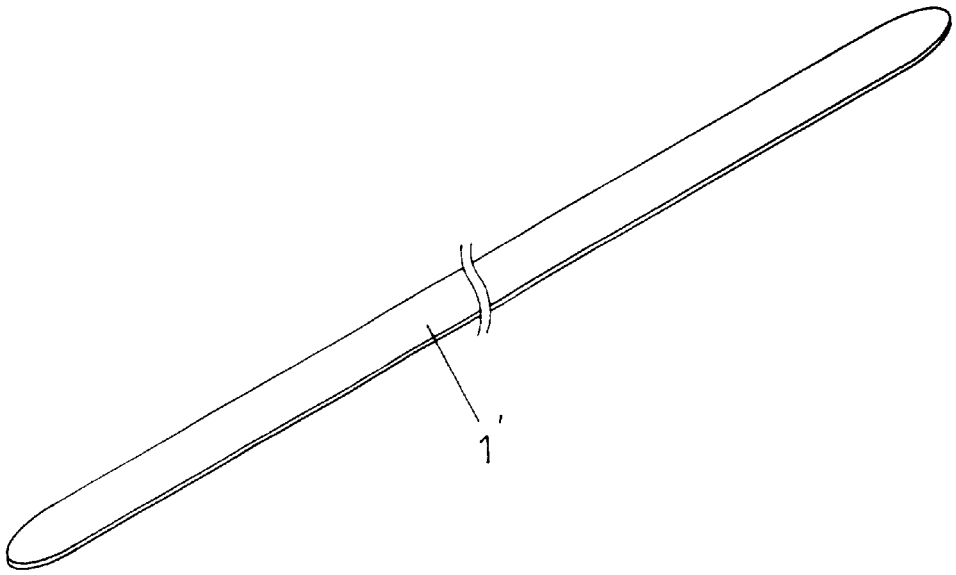
FIG. 6 PRIOR ART
FIG. 6 is a perspective view of a conventional strap for swimming/diving goggles.
Figure 7:
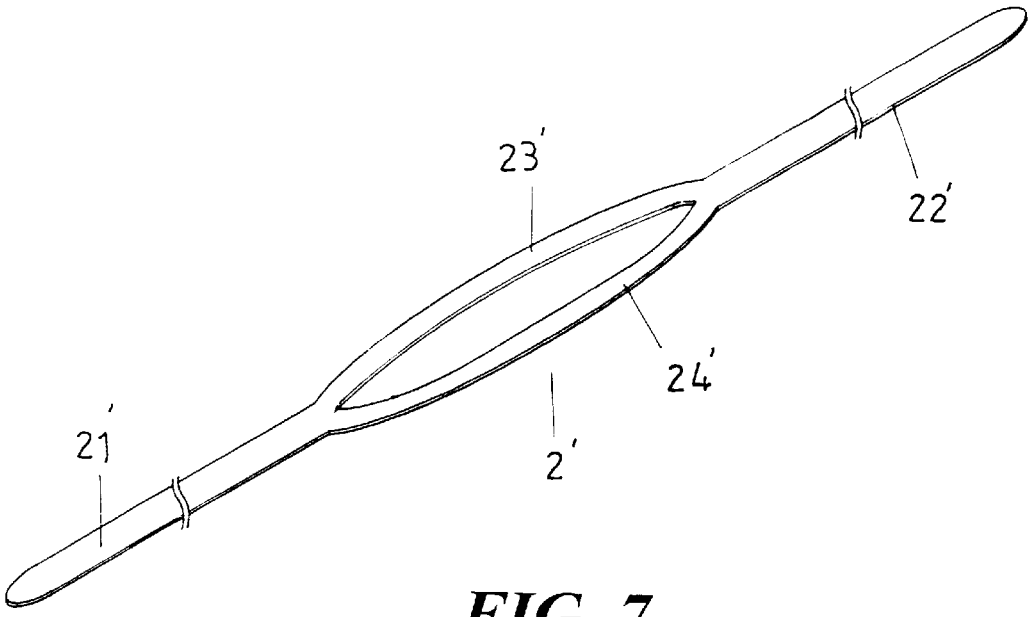
FIG. 7 PRIOR ART
FIG. 7 is a perspective view of another conventional strap for swimming/diving goggles.
Figure 8:
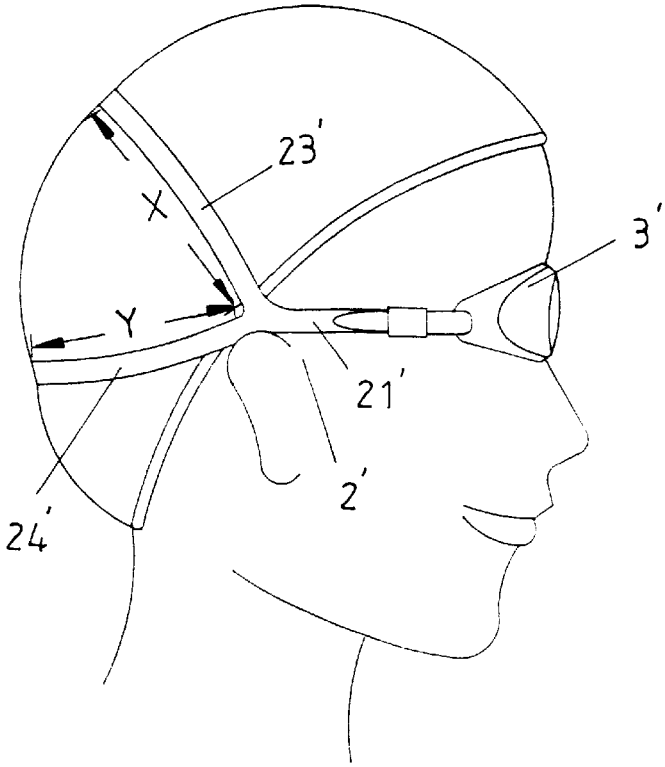
FIG. 8 PRIOR ART
FIG. 8 is a schematic view illustrating use of the strap in FIG. 7.
Figure 9:
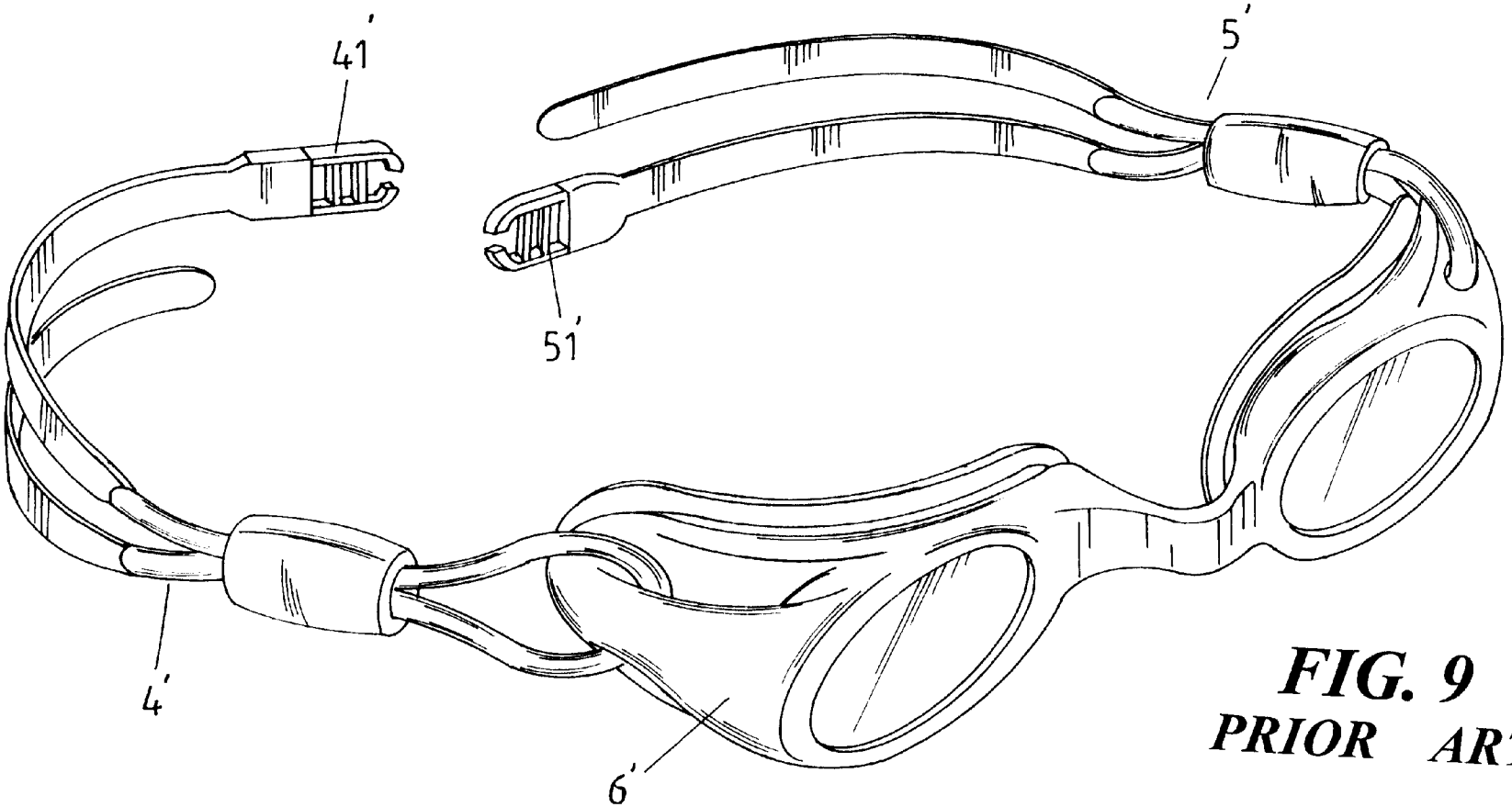
FIG. 9 PRIOR ART
FIG. 9 is a perspective view of a further conventional strap for swimming/diving goggles.

FIG. 4 illustrates another embodiment of the strap (now designated by "3"), wherein the upper loop section (now designated by "31") has a thickness smaller than that of the lower loop section (now designated by "32"). Again, the loop sections 31 and 32 have different stretchability. Nevertheless, when applied to the rear of the user's head, the loop sections 31 and 32 are stretched by different lengths and thus have the same restoring/retaining force, thereby providing reliable retaining effect and improved wearing comfort.

Although the invention has been explained in relation to its preferred embodiment, it is to be understood that many other possible modifications and variations can be made without departing from the spirit and scope of the invention as hereinafter claimed.

What is claimed is:

1. A strap for retaining a pair of water goggles worn by a user comprising:

a looped mediate portion and a pair of end portions having substantially similar length dimensions extending therefrom, said looped mediate portion including at least one stretchable upper loop section and at least one stretchable lower loop section for respectively extending over predetermined portions of the user's head;

said upper and lower loop sections being of substantially uneven stretchability for maintaining substantially even tension when extended to uneven respective lengths over the predetermined portions of the user's head.

2. The strap as recited in claim 1 wherein said upper and lower loop sections are respectively formed with uneven width dimensions.

3. The strap as recited in claim 1 wherein said upper and lower loop sections are respectively formed with uneven thickness dimensions.

* * * * *